US006588237B2

(12) United States Patent
Cole et al.

(10) Patent No.: US 6,588,237 B2
(45) Date of Patent: Jul. 8, 2003

(54) KNITTED FABRIC

(75) Inventors: Claire Cole, Slough (GB); Michael Starbuck, Slough (GB); Phillip Sharrocks, Slough (GB); Andrew Ratcliffe, Slough (GB)

(73) Assignee: Sara Lee Corporation, Winston-Salem, NC (US)

( * ) Notice: Subject to any disclaimer, the term of this patent is extended or adjusted under 35 U.S.C. 154(b) by 0 days.

(21) Appl. No.: 10/079,839

(22) Filed: Feb. 20, 2002

(65) Prior Publication Data

US 2002/0148258 A1 Oct. 17, 2002

(30) Foreign Application Priority Data

Feb. 20, 2001 (GB) ..... 0104143

(51) Int. Cl.[7] ..... D04B 7/16
(52) U.S. Cl. ..... 66/202; 66/201
(58) Field of Search ..... 66/202, 169 A, 66/172 R, 172 E, 174, 201, 190, 198; 442/318, 304, 306, 311

(56) References Cited

U.S. PATENT DOCUMENTS 3,796,066 A * 3/1974 Millar ..... 28/154
4,818,316 A * 4/1989 Weinle et al. ..... 156/148
5,239,846 A * 8/1993 Kitaura et al. ..... 66/172 R
6,158,253 A * 12/2000 Svoboda et al. ..... 2/239
6,212,914 B1 * 4/2001 Kolmes et al. ..... 2/162
6,230,524 B1 * 5/2001 Kolmes et al. ..... 57/210
6,367,290 B2 * 4/2002 Kolmes et al. ..... 2/162

FOREIGN PATENT DOCUMENTS

| | | |
|---|---|---|
| DE | 25 23 772 | 12/1976 |
| DE | 38 05 234 A1 | 8/1989 |
| DE | 295 04 780 U1 | 8/1995 |
| DE | 197 38 433 A1 | 4/1998 |
| DE | 198 55 542 A1 | 6/2000 |
| EP | 0 758 693 A1 | 2/1997 |
| EP | 0 833 000 A1 | 4/1998 |

* cited by examiner

*Primary Examiner*—Danny Worrell
(74) *Attorney, Agent, or Firm*—Ohlandt, Greeley, Ruggiero & Perle, L.L.P.

(57) ABSTRACT

A knitted fabric comprising a plurality of knitted stitches which are interconnected to define a plurality of courses and wales, the knitted stitches being formed from a heat fusible yarn, with at least some of said stitches being formed from said heat fusible yarn plated with a ground yarn, the heat fusible yarn being fused together at adjacent points of contact on stitches in order to give the fabric a desired dimensional stability and shape.

7 Claims, 2 Drawing Sheets

KNITTED FABRIC

The present invention relates to a warp or weft knitted fabric, in particular but not exclusively, a knitted fabric suitable for making garments.

FIELD OF THE INVENTION

Fabrics for garments are commonly knitted using thermoplastics yarns such as polyamide or polyesters. The fabric may be knitted using either warp knitting or weft knitting techniques.

Once knitted, it is common for the fabric to be heat set in order to give the fabric stable dimensions and/or shape. Heat setting is achieved by stretching the fabric to the required dimension/shape and raising the temperature of the fabric to the setting temperature of the yarn whereat a permanent change is induced viz. a new memory position is introduced into the yarn and it loses some of its stretch recovery capabilities and usually becomes relatively stiff. The fabric therefore thereafter retains the dimension/shape to which it was stretched during the heat setting process.

Accordingly, once the fabric has been heat set, it tends to lose its soft feel and handle qualities.

SUMMARY OF THE INVENTION

A general aim of the present invention is to provide a knitted fabric which is knitted using thermoplastics yarns as ground yarns and which is dimensionally stable without fully heat setting of the ground yarns.

According to one aspect of the present invention there is provided a knitted fabric comprising a plurality of knitted stitches which are interconnected to define a plurality of courses and wales, the knitted stitches being formed from a heat fusible yarn, with at least some of said stitches being formed from said heat fusible yarn plated with a ground yarn, the heat fusible yarn being fused together at points of contact on adjacent stitches in order to give the fabric a desired dimensional stability and shape.

According to another aspect of the invention there is provided a process for setting the coursewise and walewise dimensions and/or three dimensional shape of a fabric, the process including the steps of knitting a fabric so as to comprise a plurality of knitted stitches which are interconnected to define a plurality of courses and wales, the knitted stitches being formed from a heat fusible yarn with at least some of said stitches being formed from heat fusible yarn plated with a ground yarn having a setting temperature greater than the fusing temperature at which the heat fusible yarn become fusible, stretching the fabric on a former to stretch the fabric to desired coursewise and walewise dimensions and/or three dimensional shape, heating the fabric whilst on said former to at least the fusing temperature and preferably below said heat setting temperature, in order to cause the fusible yarn to fuse together at points of contact between the fusible yarn and subsequently cooling and removing the fabric from the former.

Preferably the heat fusible yarn is an elastomeric yarn.

Preferably the ground yarn is a thermoplastics yarn such as a polyamide or polyester. The heat fusible yarn is fusible at a temperature below the heat setting temperature of the thermoplastics yarn; the difference in these temperatures being dependent on the fibre type and the method of heating to effect fusing.

BRIEF DESCRIPTION OF THE DRAWINGS

Various aspects of the present invention are hereinafter described, with reference to the accompanying drawings, in which.

DETAILED DESCRIPTION OF THE INVENTION

Figure 1:
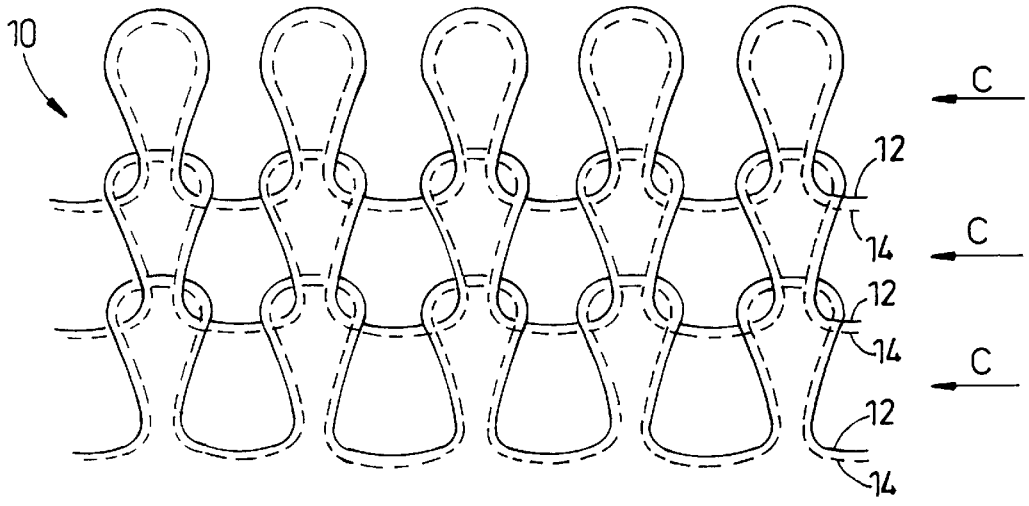
FIG. 1 is a schematic stitch diagram of part of a weft knitted fabric according to a first embodiment of the present invention shown in a stretched condition prior to a setting operation.
Figure 2:
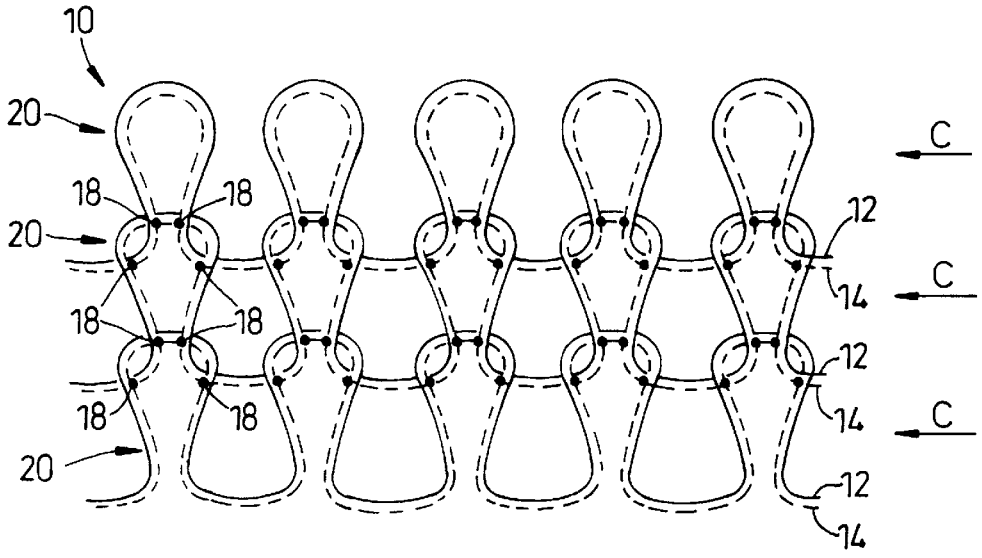
FIG. 2 is a schematic stitch diagram of the weft knitted fabric of FIG. 1 after a setting operation.

A weft knitted fabric 10 according to a first embodiment of the present invention is illustrated in FIGS. 1 and 2. The fabric 10 includes a plurality of courses C each of which is knit using at least two yarn ends, viz. a ground yarn 12 and a heat fusible yarn 14 which serves the function of providing the fabric with desired dimensions and/or shape after a heat treatment.

The ground yarn 12 provides the body to the fabric and is preferably a thermoplastic yarn such as a polyamide or a polyester. The weight of the ground yarn is preferably in the range of 10–200 dtex, more preferably in the range of 60 to 80 dtex.

The heat fusible yarn is formed from a thermoplastics material which at a predetermined fusible temperature will fuse with itself at points of contact of the heat fusible yarn.

The weight of the fusible yarn is preferably in the range of 10 to 160 dtex, more preferably in the range of 20 to 50 dtex.

In this specification, the term 'fusible' is used to denote the condition where the yarn is able to bond to itself by the application of heat whilst retaining its integrity as a yarn; in other words the fusible temperature of the yarn is the temperature at or above which it becomes sufficiently tactile for it to bond or weld to itself but is below the temperature at which the yarn fully melts. For example, the 'sticking point' of elastomeric yarns would be in the region of 150 to 170 degrees C., i.e. this is the temperature at which the fusing would become active. This is the temperature based on 'dry' heat. The temperatures in the presence of steam would be considerably lower. The normal setting temperature of the ground yarns would be in excess of 180 degrees C. in dry heat.

Thus, the predetermined fusible temperature is lower than the temperature at which the fusible yarn 14 melts and is also lower than the temperature at which the thermoplastic ground yarn 12 fully sets.

Accordingly, as schematically illustrated in FIG. 2, if the fabric 10 is stretched, for example is placed upon a former, and is then raised to the predetermined fusible temperature, the points of contact between the fusible yarn become tactile and fuse together to define fused connections 18. Since the fusible temperature is below the temperature at which the fusible yarn 14 fully melts, the stitches 20 formed by the fusible yarn remain intact. The fused connections 18 thereby lock the stitches 20 formed by the fusible yarn 14, i.e. stitch lengths inbetween each adjacent pair of connections 18 are fixed throughout the fabric.

Since the fusible yarn 14 is knitted on adjacent courses and wales throughout the fabric, the relative position/sizes of stitch loops created by both the fusible and ground yarns immediately prior to creation of the fused connections 18 are maintained thereby giving the fabric a desired dimension/shape.

Accordingly, the fusible yarn 14 acts to 'set' the fabric at a desired dimension/shape without requiring the thermoplastic ground yarn 12 to be fully set. It will therefore be appreciated that the ground yarn 12 is more flexible and has more stretch recovery than a fully set thermoplastic ground yarn and that, as a result, the fabric of the present invention has improved feel and handle qualities.

Desirably the fusible and ground yarns are chosen such that at the predetermined fusible temperature of the fusible yarn 14, the ground yarn 12 is partially set, i.e. the ground yarn 12 is given a degree of shape retention or memory. This assists in giving stability to the shape/dimension of the fabric whilst still providing the benefits of improved feel/handle qualities when compared with a fully set ground yarn.

The relative weights of the ground and fusible yarns are chosen to ensure that the fusible yarns 14 contact one another at adjacent stitches (i.e. the ground yarns are not sufficiently large to shield the fusible yarns 14 from one another).

Preferably the fusible yarn 14 is an elastomeric yarn such as a bare Lycra (RTM) or Roice (RTM).

The use of an elastomeric yarn as the fusible yarn gives the advantage of providing the fabric with stretch qualities which enhance close shape fitting of a garment on the body of a wearer.

Alternatively, the fusible yarn 14 may be a non-elastomeric yarn such as a thermoplastic monofilament yarn produced from polyamide, polypropylene or other polymer with a lower setting, softening or melting temperature than the ground yarn.

Figure 3:
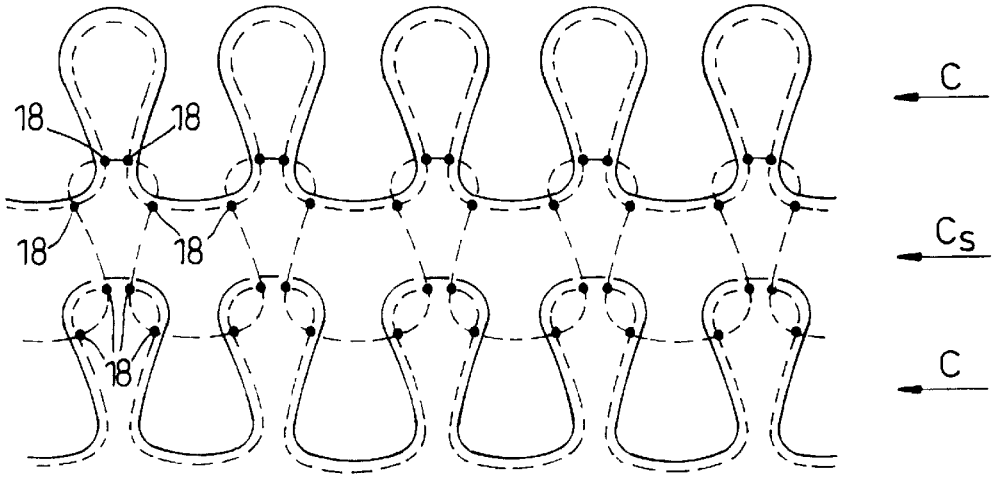
FIG. 3 is a schematic stitch diagram similar to FIG. 2 showing a weft knitted fabric according to a second embodiment of the present invention.

In the alternative embodiment 30 illustrated in FIG. 3, a fabric is illustrated having single courses $C_S$ of heat fusible yarn 14 only alternating with courses C of fusible yarn 14 plaited with ground yarn 12. Instead of a single course $C_S$ located inbetween courses of plated yarns 12 and 14 it will be appreciated that a desired number of adjacent courses $C_S$ may be provided.

The combination of the number of adjacent courses formed from plated ground and fusible yarns and the number of adjacent courses formed from fusible yarns only may be varied as required in order to provide the fabric with desired characteristics. An important consideration is that each stitch contains the fusible yarn 12 such that connections 18 may be formed at each stitch.

In the examples given in FIGS. 1 and 3, the fabric is shown as being formed from plain jersey stitches only.

It will be appreciated that the fabric may also include other conventional stitches such as tuck or miss-stitches.

The fabric of the present invention is particularly suited to the creation of seamless garments wherein a tubular blank of fabric is moulded to a three dimensional shape on a former.

For example, a former in the shape of a human body part, for example the torso, is provided for the shaping of garments such as brassieres or briefs.

A tube of fabric as described above is located upon the former and elevated in temperature to the heat fusible temperature of the fusible yarn which is a high enough temperature to cause the heat fusible yarn to bond or weld together at its points of contact; the fusible temperature however being lower than the temperature at which the ground yarns are fully set. Preferably the fabric is heated using live steam.

Once the fabric has been exposed to a temperature whereat the heat fusible yarn has welded to itself, the fabric structure is locked in its stretched condition and slightly contracts (due to the stretch recovery of the heat fusible yarn). Accordingly the size of the former is chosen to be slightly oversize in order to cater for the slight contraction of the garment when removed from the former.

It is envisaged that heat meltable yarns may be incorporated into the fabric so as to join regions of fabric together. These heat meltable yarns are chosen so as to completely melt when the fabric is exposed to the fusible temperature and thereby cause the regions of fabric joined thereby to separate leaving a welded edge formed by the melted heat meltable yarn and which is of a desired shape and which is run resistant. This enables the garment to be shaped by pattern control techniques during knitting and avoids the need for a separate cutting-out process to shape the garment from the tubular blank.

It is envisaged that the former may be made from a resin polymer and be provided with a heat sink to prevent the surface of the former retaining a surface temperature equal to or above the welding temperature after repeated fabric moulding operations.

The present invention having been thus described with particular reference to the preferred forms thereof, it will be obvious that various modifications may be made therein without departing from the spirit and scope of the present invention as defined in the appended claims.

What is claimed is:

1. A knitted fabric comprising a plurality of knitted stitches, said plurality of knitted stitches being interconnected to define a plurality of courses and wales, said plurality of knitted stitches being formed from a heat fusible yarn, said heat fusible yarn being fused at adjacent points of contact on said plurality of knitted stitches thereby providing said knitted fabric a desired dimensional stability and shape, and wherein one or more of said plurality of knitted stitches is formed from said heat fusible yarn plated with a ground yarn.

2. A fabric according to claim 1, wherein said heat fusible yarn is a bare elastomeric yarn.

3. A fabric according to claim 1, wherein the ground yarn is a thermoplastics yarn capable of being fully set when elevated to a fully set temperature, said heat fusible yarn being fusible at a temperature below said fully set temperature.

4. A process for setting the coursewise and walewise dimensions and three dimensional shape of a fabric comprising:

knitting a fabric having a plurality of knitted stitches, said plurality of knitted stitches being interconnected to define a plurality of courses and wales, wherein said knitted stitches are formed from a heat fusible yarn, and wherein some of said knitted stitches are formed from said heat fusible yarn plated with a ground yarn;

stretching said fabric on a forming device to stretch said fabric to a desired coursewise and walewise dimension and three dimensional shape;

heating said fabric while on said forming device to a fusing temperature in order to cause said fusible yarn to fuse together at points of contact between said plurality of knitted stitches; and cooling and removing said fabric from said forming device.

5. A process according to claim 4, wherein said ground yarn is a thermoplastics yarn capable of being fully set when elevated to a fully set temperature, and wherein said heating of the fabric whilst on the former is preformed to elevate the fabric to a temperature greater than said fusing temperature but less than said fully set temperature.

6. A process according to claim 4, wherein the fabric is further knitted using heat meltable yarns in order to join regions of said fabric together, said heat meltable yarns being melted when raising the fabric to said heat fusible temperature so as to cause said regions of fabric to separate and define, where separated, a run resistant edge of a desired shape.

7. A garment formed at least in part from a knitted fabric according to claim 1.

* * * * *